US006230451B1

(12) United States Patent
Stoller

(10) Patent No.: US 6,230,451 B1
(45) Date of Patent: May 15, 2001

(54) ICE SKATING RINK STRUCTURE

(75) Inventor: James E. Stoller, Twin Lakes, WI (US)

(73) Assignee: Sto-Cote Products, Inc., Genoa City, WI (US)

( * ) Notice: Subject to any disclaimer, the term of this patent is extended or adjusted under 35 U.S.C. 154(b) by 0 days.

(21) Appl. No.: 09/309,426

(22) Filed: May 11, 1999

(51) Int. Cl.[7] ..... A63C 19/10

(52) U.S. Cl. ..... 52/169.1; 52/102; 52/155; 52/169.7; 52/699; 52/741.12; 62/235; 4/494; 472/90; 220/9.4; 249/3; 249/DIG. 3; 248/545

(58) Field of Search ..... 52/169.1, 169.7, 52/169.8, 102, 155, 699, 712, 714, 741.12; 62/235; 4/494, 506; 472/90; 220/9.4; 47/33; 248/156, 545; 249/2, 3, 6, 192, 208, DIG. 3; 256/19

(56) References Cited

U.S. PATENT DOCUMENTS

| | | | | |
|---|---|---|---|---|
| 1,382,082 | * | 6/1921 | Heltzel | 249/6 |
| 1,741,829 | * | 12/1929 | Cucolo | 249/207 |
| 2,996,896 | * | 8/1961 | Johnson | 62/235 |
| 3,012,596 | * | 12/1961 | Skolout | 62/235 |
| 3,444,659 | * | 5/1969 | Shanni | 52/155 X |
| 3,797,049 | * | 3/1974 | De Santo | 62/235 |
| 3,930,647 | * | 1/1976 | Berlemont | 62/235 X |
| 3,933,002 | * | 1/1976 | Vickery | 62/235 X |
| 4,022,437 | * | 5/1977 | French | 249/3 X |
| 4,508,319 | * | 4/1985 | Tappan et al. | 256/19 |
| 4,533,112 | * | 8/1985 | Santos, Jr. et al. | 249/3 |
| 4,548,005 | * | 10/1985 | Glonek et al. | 52/155 |
| 5,134,857 | * | 8/1992 | Burley | 62/235 |
| 5,174,083 | * | 12/1992 | Mussell | 52/169.1 |
| 5,230,187 | * | 7/1993 | Reimann | 52/102 |
| 5,489,165 | * | 2/1996 | Smith | 52/169.7 X |
| 5,562,272 | * | 10/1996 | McAbee et al. | 249/2 |
| 5,622,021 | * | 4/1997 | Bookout | 52/152 X |
| 5,817,247 | * | 10/1998 | Colatruglio | 249/3 X |

FOREIGN PATENT DOCUMENTS

| | | | | |
|---|---|---|---|---|
| 1127677 | * | 7/1982 | (CA) | 472/90 |

OTHER PUBLICATIONS

Riverside Rink Internet Web Pages, Nov. 1998.
ICE N' GO Brochure, Farley Ice Technologies, Inc., Oct. 23, 1997.
NiceRink Ice Stuff Brochure, pp. 2–4, 7–8, 1998.
FreezeFrame Backyard Skating Rink Brochure, Dinky Rink, Inc., circa 1999.

* cited by examiner

*Primary Examiner*—Laura A. Callo
(74) *Attorney, Agent, or Firm*—George H. Gerstman; Seyfarth Shaw

(57) ABSTRACT

An ice skating rink structure comprising a plurality of boards and a plurality of brackets is provided. Each of the brackets has a U-shaped support for holding one or more of the boards and has at least one downward projection for insertion into the ground. The downward projection of the bracket is inserted into the ground and boards are placed within the U-shaped support such that the boards define the shape of an ice skating rink. A liner is placed inside of the ice skating rink and water is poured onto the liner and allowed to freeze and form an ice skating rink. By using boards with different heights, the present invention allows for the quick assembly of an ice skating rink on level or unlevel ground.

36 Claims, 4 Drawing Sheets

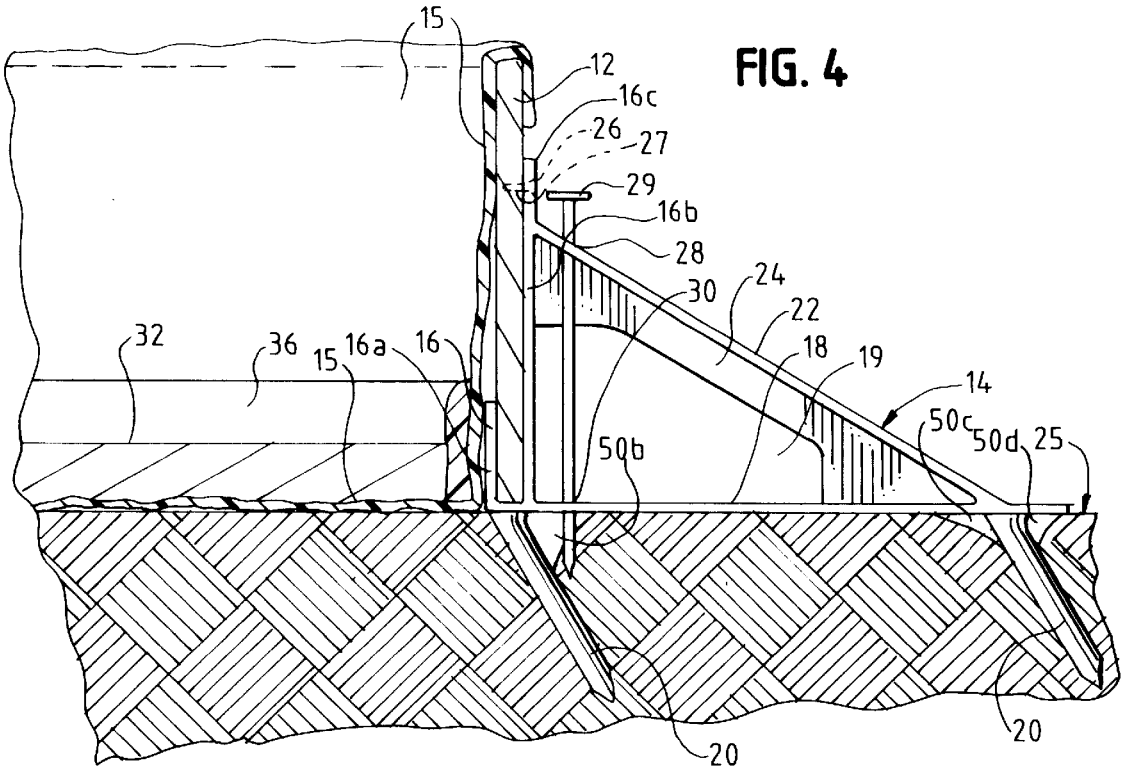
FIG. 4
FIG. 5
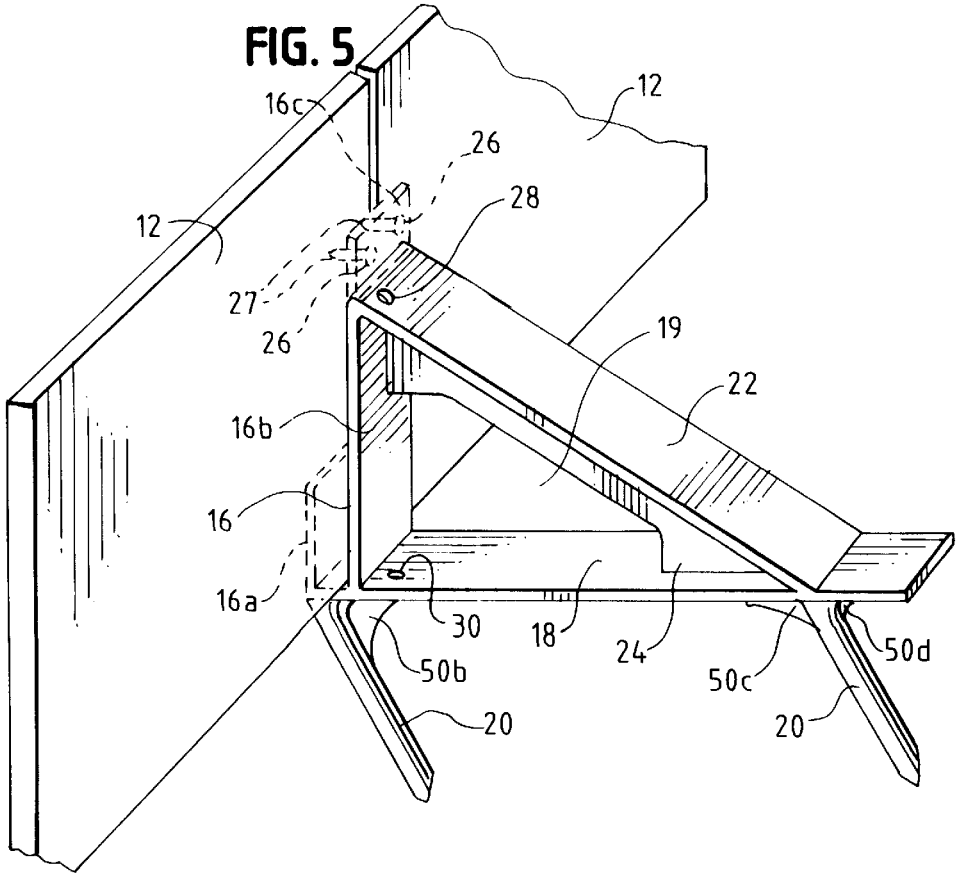

ICE SKATING RINK STRUCTURE

FIELD OF THE INVENTION

The present invention concerns a novel temporary upright perimeter for use as an ice skating rink.

BACKGROUND OF THE INVENTION

The increased popularity of ice skating in cold weather areas has led to great competition for the limited resources of the public and private ice skating venues presently available. As a result, the costs of using private ice skating facilities has increased dramatically and public rinks must generally maintain long hours to accommodate the large numbers of hockey teams, figure skaters and the desires of the general public for time on the ice. Often times a hockey club or those practicing for competitive figure skating will be forced to accept practice time in the very late evenings or very early morning hours.

Traditionally, skaters have used a frozen lake or pond on which to skate in the winter time. Where a lake or pond is not available a field has been flooded and allowed to freeze-up to provide a skating surface. This is done by flooding an area with water until the ground is saturated and the local water table rises above ground level and allowing the water to freeze. However, because of variable weather conditions in the winter months, skating on frozen ponds and lakes is extremely dangerous and the ice on flooded fields may melt causing a loss of all of the water poured onto the field.

Presently, the method used to make an outdoor skating rink is to create some sort of perimeter, place a liner in the perimeter, fill it with water and let it freeze. The perimeters have generally been constructed by driving dimensional lumber, such as two-by-twos or two-by-fours, part way into the ground, as a structure, and then attaching plywood, using nails or screws, to the structure to form the perimeter. On flat fields such a system, while requiring a great deal of labor to construct, works well. However, where there is a slope to the ground, as in most areas, the perimeter must be made so that the walls on the downward part of the slope are high enough to contain the deepest portion of the water. Often times during construction of the rink structure, because a field will often look more level than it is, the height of the water is not taken into account until water is poured into the rink. After the water is poured into the rink it is difficult to remove a section, or entire wall, of plywood and/or to drive more or larger dimensional lumber into the ground for support.

Also, such construction generally must begin early in the season while the ground is still soft enough to drive dimensional lumber into the ground. Because of the variability of weather, it has often been found that the effort of constructing such a rink is lost because a winter season is not cold enough to allow skating often enough or long enough to justify the effort of such construction. As a result, owners of these rinks are discouraged from exerting the effort to construct such rinks in future years. Also, driving large pieces of lumber into the ground, to construct the structure of the rinks, causes considerable damage to a field, or back yard, which must be repaired in the summer time.

It is therefore an object of the present invention to provide an ice skating rink structure that is easy and quick to construct.

It is another object of the present invention to provide an ice skating rink structure that can be easily used on level or sloped ground.

It is a further object of the present invention to provide an ice skating rink structure that can easily accommodate various sizes of plywood, or other boards, and that can allow the easy removal and replacement of boards.

It is another object of the present invention to provide an ice skating rink structure which can be easily constructed at any time during the winter season without regard to the condition of the soil.

It is another object of the present invention to provide a skating rink structure that can be installed and removed without causing great damage to a field or lawn.

Other objects and advantages of the present invention will become apparent as the description proceeds.

SUMMARY OF THE INVENTION

In accordance with the present invention, an ice skating rink structure is provided, comprising a plurality of boards and a plurality of brackets, each bracket having at least one downward projection for insertion into the ground and a receptacle, preferably in the form of a generally U-shaped support, for holding one or more of the boards. The downward projection of the bracket is inserted into the ground and boards are placed within the receptacle or U-shaped support such that said boards define the shape of an ice skating rink.

In the illustrative embodiment, the brackets used to support the boards of the structure are generally triangular in shape, having a U-shaped support member into which one or more plywood boards may be inserted. In the preferred embodiment, the U-shaped support member is designed to accommodate boards, of varying height, having a thickness of ¾ inch or less. The U-shaped support members removably hold the boards that will form the perimeter of the skating rink, such that if a taller board is required in one section of the skating rink, the existing board may be quickly removed and replaced, without the removal of fasteners.

The brackets, in the illustrative embodiment, comprise a base having two downward projections, or spikes, which may be driven into the ground. A support brace, forming the hypotenuse of the triangular member, is provided to strengthen the U-shaped support member. In the illustrative embodiment, an opening is provided in the support brace and in the base of the bracket so that a large rod, such as a spike or a concrete form stake, may be driven through the bracket and into the ground to provide more support for the ice rink structure.

In one embodiment of the present invention, holes are provided at the top of the bracket so that the bracket and board may be fastened together, by screws, nails or other fasteners, once the appropriate height of board has been installed. In one embodiment, the bracket is generally triangular in shape, having a U-shaped support member to hold a board in place, a base and a support brace joined to form a triangle. A space or opening, above the base, is left in the triangle to allow the user to step onto the bracket and drive the downward projections into the ground.

Further, in accordance with the present invention a method of constructing an ice rink structure is described, including the steps of driving the projections of the bracket of the present invention into the ground, placing appropriate plywood boards within the U-shaped support member, placing, a water impermeable lining within the rink and filling the rink with water.

A more detailed explanation of the invention is provided in the following description and claims and is illustrated in the accompanying drawings.

BRIEF DESCRIPTION OF THE DRAWINGS

FIG. 4. is a cross sectional view of the ice skating rink taken along the plane of line 4—4 of FIG. 1.

FIG. 5. is a perspective view of the bracket of FIG. 2 shown holding two boards.

DETAILED DESCRIPTION OF THE ILLUSTRATIVE EMBODIMENT

Figure 1:
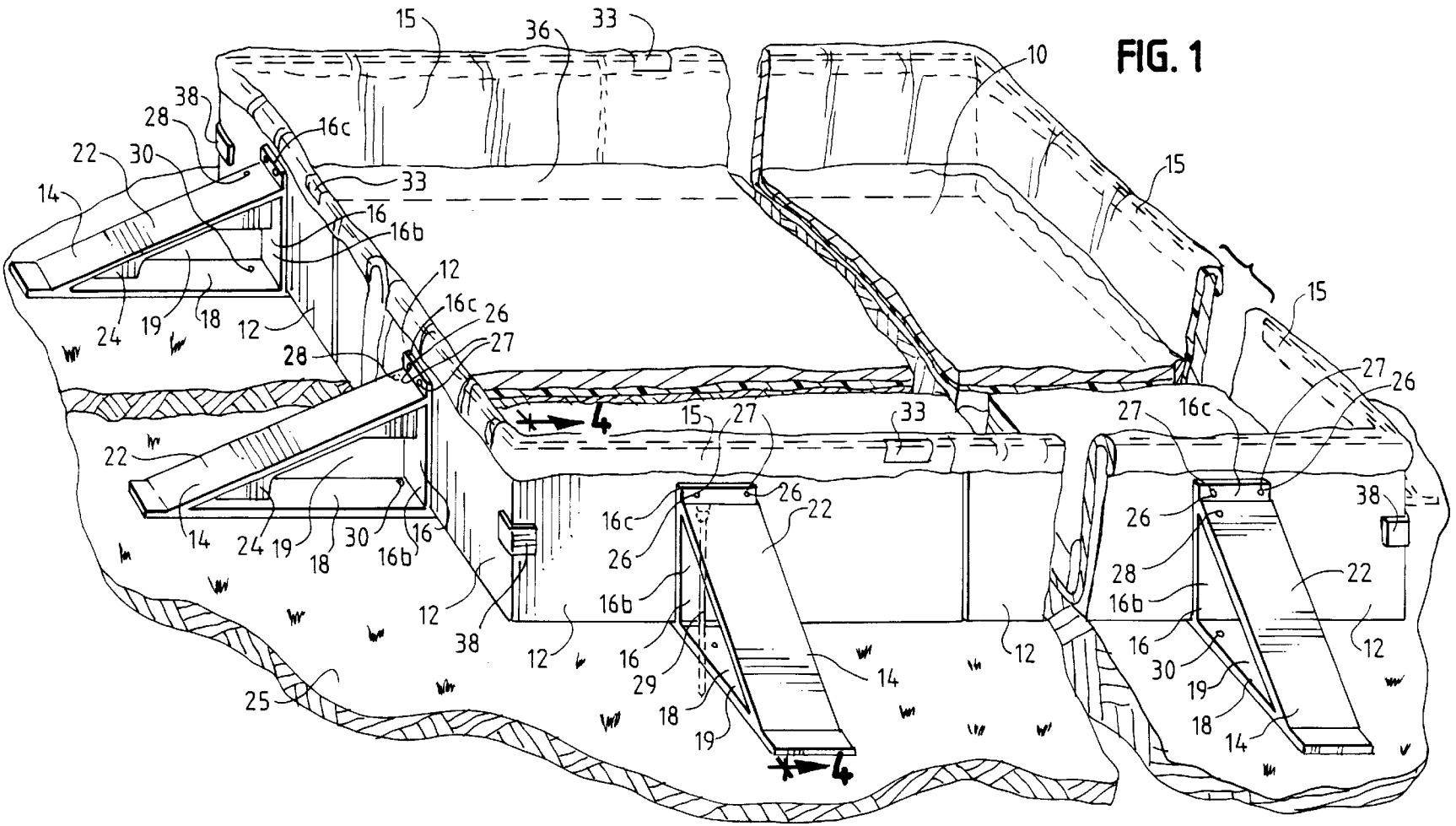
FIG. 1. is a perspective view, partially broken apart, of an ice skating rink structure constructed in accordance with the teachings of the present invention.

Referring to the drawings, FIG. 1 is a perspective view of an ice skating rink 10 constructed in accordance with the teachings of the present invention. The ice rink 10 comprises a plurality of boards 12 and brackets 14 which when assembled make an ice rink structure 11. Boards 12 are preferably made of ¾ inch plywood; however, any type of board, having any variety of thicknesses, widths and heights, may be used without departing from the scope of the present invention.

In the preferred embodiment, ¾ inch plywood having a length of approximately eight feet and a height of approximately 12 inches is used. A liner 15 is placed on the boards 12 and laid within the ice rink structure 11 so that water may be poured into the ice rink 10 and not escape into the ground. Liner 15 is comprised of a water impermeable cloth, such as high density cross-laminated polyethylene, high density isotopically oriented polyethylene or woven high density polyethylene, produced by Sto-Cote Products Co. of Genoa City, Wis. It is to be understood that any type of water impermeable fabric, or fabric treated to make the fabric impermeable to water, may be used without departing from the novel scope of the present invention.

Figure 2:
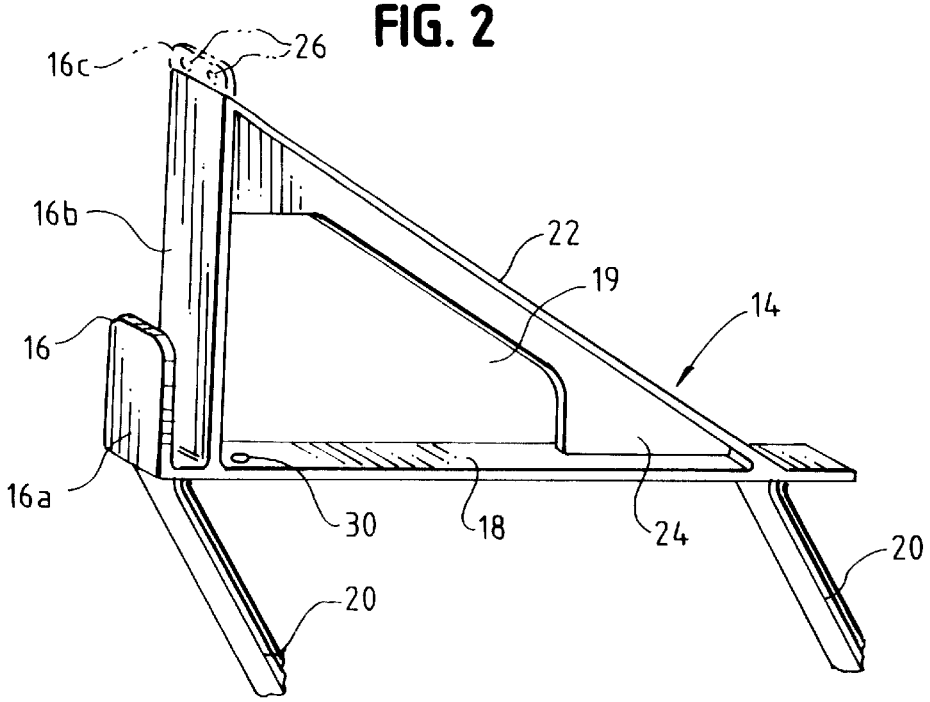
FIG. 2. is a perspective view of a bracket constructed in accordance with the teachings of the present invention.

As can be seen in FIG. 2, the bracket 14 of the illustrative embodiment of the present invention is generally a triangular shaped bracket having a generally U-shaped support member 16, from which a base 18 extends. In the illustrative embodiment, a first leg 16*a* of U-shaped support member 16 is shorter than a second leg 16*b* of U-shaped support member 16. Brackets 14 are designed to hold boards 12 within legs 16*a* and 16*b* of the U-shaped support member 16. Base 18 has at least one projection 20, in the form of a spike. In the preferred embodiment of the present invention, base 18 has two downward projections 20, spaced separately and having a length of 6 inches. It is to be understood that base 18 may have any number of downward projections 20 of any length without departing from the novel scope of the present invention.

In the illustrative embodiment, bracket 14 is molded from plastic materials. It is to be understood, however, that bracket 14 may be constructed of any rigid material, including aluminum, steel, fiberglass or other material without departing from the novel scope of the present invention. Further, in the illustrative embodiment, anti-deterioration additives, such as ultra-violet stabilizers for plastic brackets and galvanizing or other anti-corrosive agents on metal brackets are used on bracket 14.

Bracket 14 is shown having a bracing member 22 which extends between the top of leg 16*b* of U-shaped support member 16 and base 18. Bracket 14 is illustrated having a fillet 24 for added strength. Bracket 14, further, is constructed so that an opening 19 is defined above base 18. Opening 19 allows for the placement of a foot onto base 18 so that projections 20 of bracket 14 may be more easily inserted into the ground.

Figure 6:
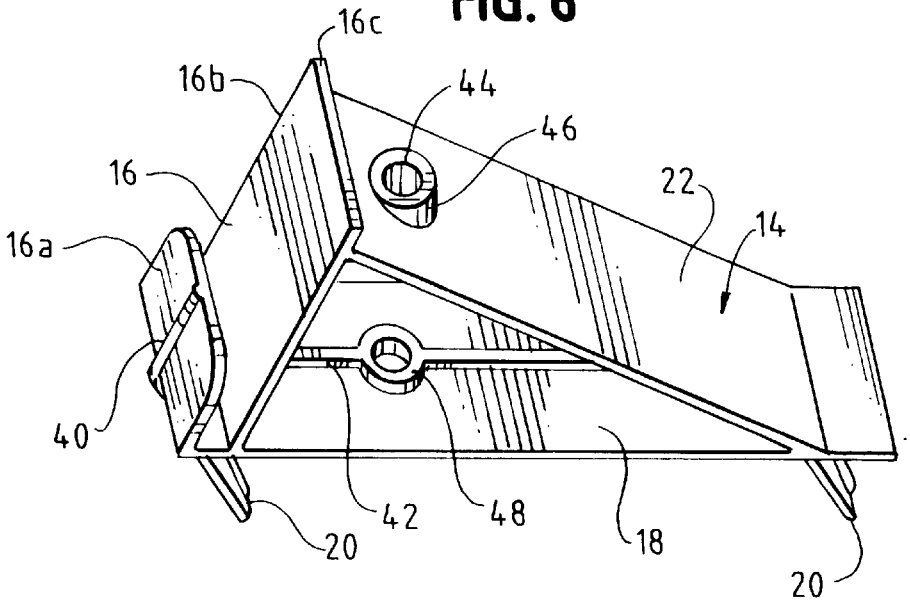
FIG. 6. is a perspective view of another embodiment of a bracket constructed in accordance with the teachings of the present invention.

An optional extension 16*c* to leg 16*b* of U-shaped support member 16 is shown in FIG. 2. In the illustrative embodiment, extension 16*c* defines two holes 26 to allow for the easy attachment of a bracket 14 to a board 12, by means of screws, nails or other fasteners. Attachment of a bracket 14 to a board 12, in this manner, adds strength to ice skating rink structure 11. It is to be understood that any number of holes 26 may be defined in extension 16*c* without departing from the novel scope of the present invention. Further, as illustrated in FIG. 6, extension 16*c* may be made without a hole defined in extension 16*c*, allowing the user to drill and place fasteners at any desired location, or to make an ice skating rink structure without fastening boards 12 to brackets 14.

Figure 3:
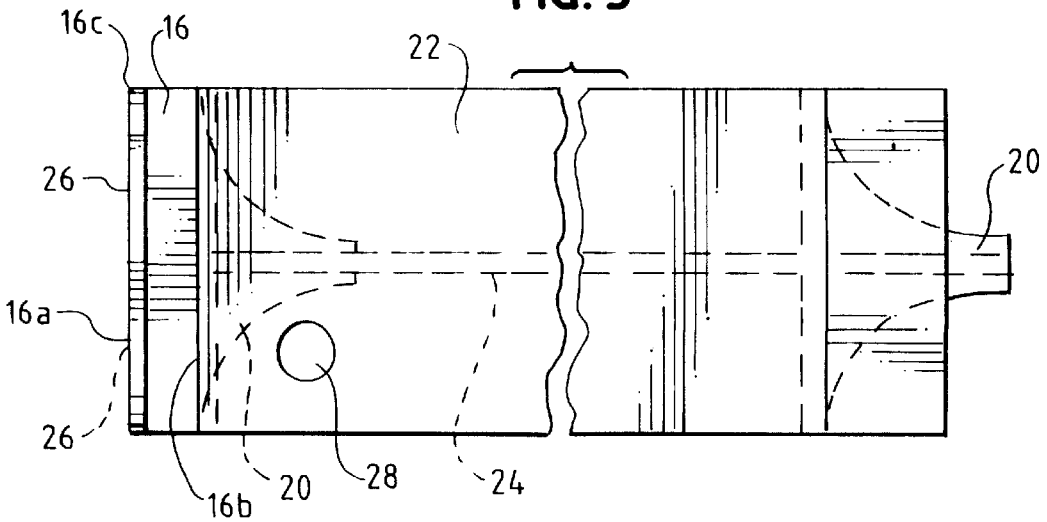
FIG. 3. is a plan view of the top of the bracket of FIG. 2.

Bracket 14, further defines an opening 28 (FIG. 3) in brace support 22 and an opening 30 in base 18, aligned such that a separate spike, such as a concrete form stake, may be driven into the ground through openings 28 and 30, to assist in holding bracket 14 in place (FIG. 4).

Referring to FIG. 4, a cross-section of the ice rink 10, taken along the plane of line 4—4 of FIG. 1, is shown. It can be seen that projections 20 of bracket 14 are within the ground 25. Board 12 has been placed into U-shaped support member 16 and screws 27 have been driven into board 12 through screw holes 26 in bracket 14. It is to be understood that the driving of screws 27 in this manner is optional and that the present invention functions in the manner described herein with or without the inclusion of screws 27. Screws 27 provide added strength to the ice skating rink structure 11.

A spike 29, which in the illustrative embodiment is a concrete form stake, but can be any type of elongated member which can be driven into the ground, is shown driven into the ground 25 though openings 28 and 30 of bracket 14. Spike 29 provides added support to bracket 14 allowing better support of ice rink structure 11. It is to be understood that the use of a spike 29 in this manner is also optional and that the present invention functions in the manner described herein with or without the inclusion of spike 29.

FIG. 4 further shows a liner 15 laying on board 12 and inside of ice rink structure 11. Liner 15 contains ice 32 within ice rink structure 11. A clip 33, which is a clip of conventional design, is shown fastened to liner 15 and board 12. Clip 33 helps to keep line 15 in place such that liner 15 is restrained from blowing in the wind or falling into the rink structure 11 when water is poured onto liner 15.

In one embodiment of the present invention, brackets 14 are placed four feet apart for the entire perimeter of the desired ice skating rink. Downward projections 20 of brackets 14 are then placed on the ground and projections 20 are inserted into the ground. If the ground is hard, base 18 of brackets 14 may be stepped on, through openings 19 in brackets 14. Boards 12 are then placed into U-shape support members 16. Boards 12 may be placed centrally onto U-shaped support member 16 or, two boards may be abutted together within the U-shaped support member 16 (FIG. 5). Boards 12 may be attached to U-shaped support members 16 by means of screws 27, or other fasteners, though screw holes 26, and a spike 29, may be driven into the ground through openings 28 and 30 in brackets 14, to provide a more sturdy structure. The ice skating rink of the present invention may include kick plates 36, and comer bracing 38.

If it is discovered that due to the slope of the ground, the water level of the ice rink would be higher than the height of a section of boards 12, boards 12, of that section, may be easily lifted from U-shaped support member 16 and replaced with taller boards.

A liner 15 is then laid over boards 12 and laid onto the ground within the perimeter of ice skating rink structure 11. Clips 33 may be placed, as needed, to keep liner 15 in place. Water can then be introduced into the structure and allowed to freeze and form an ice skating rink.

Figure 7:
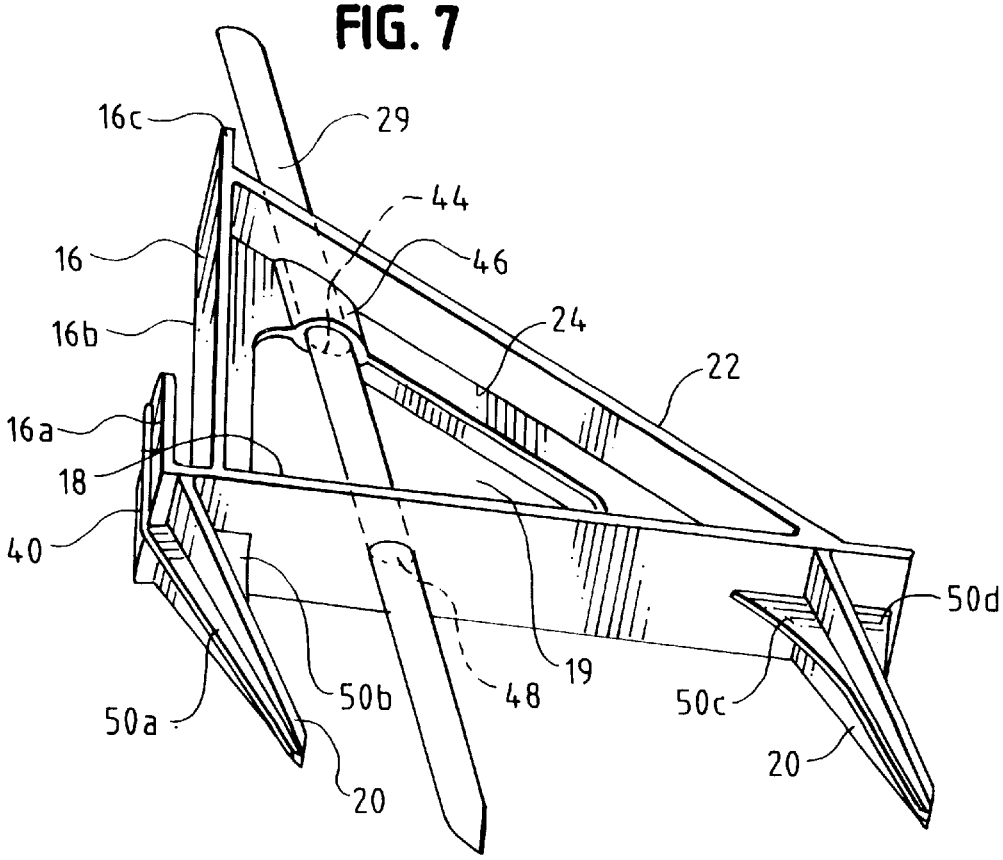
FIG. 7. is another perspective view of the bracket of FIG. 6 shown with a spike passing through the bracket.

In an alternative embodiment of the present invention, bracket 14, as seen in FIG. 6 and FIG. 7, includes a reinforcing ridge 40 on the outer side of leg 16*a* to provide added strength to bracket 14. Further, a second reinforcing ridge 42 is provided on base 18 of bracket 14, for added strength in bracket 14. In this alternative embodiment, a reinforced opening 44 is defined in brace support 22 with reinforcing tube 46 extending from brace 22 and down through fillet 24 (FIG. 7). A corresponding reinforced opening 48 is defined in base 18, through ridge 42. As can be seen in FIG. 7, a spike 29, such as a concrete form stake, may be inserted through reinforced openings 44 and 48 and into the ground to give added support to bracket 14 and ice rink structure 11. Further, reinforcing tube 46 assists in guiding spike 29 through brace 22, base 18 and into the ground. Referring to FIG. 7, it can be seen that fillets 50*a*, 50*b*, 50*c* and 50*d* have been added to downward projections 20 to strengthen downward projections 20.

It can thus be seen that I have invented an ice skating rink structure that is easy to construct, can be built on level or sloped ground, can be constructed with little or no damage to a field or back yard and can be constructed quickly. Further, the method of construction of such an ice skating rink structure allows for the quick replacement of structural elements to correct for miscalculations in the level of the ice due to the slope of the field or lawn.

Although illustrative embodiments of the invention has been shown and described, it is to be understood that various modifications and substitutions may be made by those skilled in the art without departing from the novel spirit and scope of the invention.

What is claimed is:

1. An ice skating rink structure comprising:

a plurality of boards;

a plurality of brackets, each of said brackets having at least one downward projection for insertion into the ground and a generally U-shaped support for holding one or more of said boards, said downward projection also extending outwardly away from said U-shaped support at an acute angle to vertical;

said downward projection being inserted into the ground and said boards being placed within said U-shaped support such that said boards define the perimeter of an ice skating rink.

2. The ice skating rink structure of claim 1, wherein a water impermeable liner is laid within the perimeter of said ice skating rink.

3. The ice skating rink structure of claim 1, wherein each of said brackets comprises two of said downward projections for insertion into the ground.

4. The ice skating rink structure of claim 1, wherein each of said brackets comprises said U-shaped support, a base member extending from said U-shaped support, said downward projection extending from said base member and a bracing member coupling said U-shaped support to said base member.

5. The ice skating rink structure of claim 4, wherein said bracket comprises a second of said downward projections.

6. The ice skating rink structure of claim 1, wherein the height of each of said plurality of boards is determined by a desired depth of ice at said board.

7. The ice skating rink structure of claim 1, wherein said boards are releasably attached at outer sides to said brackets.

8. The ice skating rink structure of claim 7 in which said brackets are spaced from the tops of said boards, and said brackets are free of sharp, upwardly facing edges spaced from the boards.

9. The ice skating rink structure of claim 1, wherein said U-shaped support comprises a first generally vertical leg and a second generally vertical leg, said second leg being longer than said first leg.

10. An ice skating rink structure comprising:

a plurality of boards;

a plurality of brackets, each of said brackets having at least one downward projection for insertion into the ground and a receptacle for holding one or more boards, said downward projection also extending outwardly away from said receptacle at an acute angle to vertical;

said downward projection being inserted into the ground and said boards being placed within said receptacles such that said boards define the perimeter of an ice skating rink.

11. The ice skating rink structure of claim 10, wherein said receptacle comprises a U-shaped member and a base support extending from said U-shaped member, said base support defining said downward projection for insertion into the ground, said boards being releasably attached at outer sides to said brackets, said boards having top surfaces which are spaced from said brackets.

12. An ice skating rink structure comprising:

a plurality of boards;

a plurality of brackets, each of said brackets comprising a generally U-shaped support, a base member extending from said U-shaped support, a downward projection extending from said base member and a bracing member coupling said U-shaped support to said base member;

said downward projection also extending outwardly away from said U-shaped support at an acute angle to vertical, and said U-shaped support being adapted for holding one or more of said boards;

said downward projection being inserted into the ground and said boards being placed within said U-shaped support such that said boards define the perimeter of an ice skating rink; and, a water impermeable liner laid within the perimeter of said ice skating rink.

13. The ice skating rink structure of claim 12, wherein each of said brackets also comprises a second of said downward projections.

14. The ice skating rink structure of claim 13 wherein said U-shaped support comprises a first generally vertical leg and a second generally vertical leg, said second leg being longer than said first leg and having at least one aperture connecting an attachment member through said aperture and through an outer side of one of said boards.

15. A bracket for use in forming an ice skating rink structure, comprising:

a U-shaped member for receiving a board;

a base extending from said U-shaped member, said base comprising at least one downward projection for insertion into the ground, said downward projection also extending outwardly away from said U-shaped member at an acute angle to vertical when said base is horizontal; and a bracing member coupling said U-shaped support to said base member, such that the bracket may receive a board and hold it upright and be attached to said board through the outer vertical face of said board.

16. The bracket of claim 15, wherein said U-shaped member comprises a first generally vertical leg and a second generally vertical leg, said second leg being longer than said first leg.

17. The bracket of claim 15 wherein said bracket comprises a single, integral piece.

18. The bracket of claim 15, wherein said bracing member, U-shaped member and base are coupled together defining an open space above said base so that force may be applied against said base to drive said downward projection into the ground.

19. The bracket of claim 15, wherein said U-shaped member and said base comprise reinforcing ridges for added strength.

20. The bracket of claim 15, wherein said bracing member and said base define openings through which a separate spike may be inserted and driven into the ground to support said bracket.

21. The bracket of claim 20, wherein said opening in said bracing member comprises a tubular sheath extending through said bracing member, to guide said separate spike through said bracket.

22. The bracket of claim 13, wherein said base comprises two downward projections, both projections extending outwardly away from said U-shaped support at an acute angle to vertical when the base is horizontal.

23. The bracket of claim 15 in which said bracket is free of sharp, upwardly facing edges spaced from a board in said U-shaped member.

24. The method of constructing an ice skating rink including the steps of:

providing a plurality of boards;

providing a plurality of brackets, each of said brackets having at least one downward projection and a receptacle for holding boards, said downward projection also extending outwardly away from said receptacle at an acute angle to vertical;

inserting said downward projections of said brackets in the ground and placing at least one board in each of brackets within said receptacle to form a perimeter in the shape of an ice skating rink;

placing a water impermeable liner within said perimeter and filling said perimeter with water and allowing said water to freeze within said perimeter.

25. The method of constructing an ice skating rink of claim 24, wherein any one or more of said plurality of boards may be placed into one of said brackets and then removed and replaced by any other board.

26. The method of constructing an ice skating rink of claim 24 including the step of releasably fastening said boards at their outer vertical sides to said brackets.

27. The method of constructing an ice skating rink of claim 24 including the step of driving stakes through bracket openings for receiving said stakes, enabling said brackets to be staked to the ground to give extra support to said skating rink.

28. The method of constructing an ice skating rink including the steps of:

providing a plurality of brackets, each of said brackets having at least one downward projection and a support member;

providing a plurality of boards;

inserting said downward projections of said brackets in the ground, placing at least one board in each of said brackets within said support member to form a perimeter in the shape of an ice skating rink; releasably attaching outer vertical sides of said boards to said brackets at points spaced from the tops of the boards;

placing a water impermeable liner within said perimeter and filling said perimeter with water and allowing said water to freeze within said perimeter.

29. The method of constructing an ice skating rink of claim 28, wherein any one or more of said plurality of boards may be placed into one of said U-shaped support members and then removed and replaced by any other board.

30. The method of constructing an ice skating rink of claim 28, wherein said brackets define fastener openings and such boards are fastened to said brackets with fasteners extending through the openings at outer sides of said boards and spaced from the tops of said boards.

31. The method of constructing an ice skating rink of claim 28, wherein said brackets define openings for receiving stakes enabling said brackets to be staked to the ground to give extra support to said skating rink.

32. An ice skating rink structure comprising:

a plurality of boards;

a plurality of angled brackets, each of said brackets having at least one downward projection for insertion into the ground and a fastener for attaching said bracket to one of said boards at an outer side of said boards, said downward projection also extending outwardly away from said boards at an acute angle to vertical; said downward projection being inserted into the ground and said boards being attached to said brackets such that said boards define the perimeter of an ice skating rink.

33. The method of constructing an ice skating rink including the steps of:

providing a plurality of boards;

providing a plurality of angled brackets, each of said brackets having at least one downward projection, said downward projection also extending outwardly away at an acute angle to vertical;

inserting said downward projections of said brackets in the ground and attaching at least one board to each of said brackets to form a perimeter in the shape of an ice skating rink;

placing a water impermeable liner within the perimeter, filling said perimeter with water, and allowing said water to freeze within the perimeter.

34. An ice skating rink structure comprising:

a plurality of boards;

a plurality of generally triangularly-shaped brackets, each of said brackets having a base portion, a leg, and a bracing member positioned above said base portion and connecting said leg and said base portion;

said base portion defining an opening for enabling a spike to be driven into the ground through the opening;

said leg defining an opening for enabling said bracket to be fastened to one of said boards at an outer side of said boards, spaced from the board top;

said boards being attached to said brackets such that said boards define a perimeter of an ice skating rink.

35. An ice skating rink as defined in claim 34, in which said bracing member defines an opening aligned with said base portion opening.

36. The ice skating rink structure of claims 34 in which said bracket is free of sharp, upwardly facing edges spaced from the boards.

* * * * *